US009964904B2

(12) United States Patent
Oka et al.

(10) Patent No.: US 9,964,904 B2
(45) Date of Patent: May 8, 2018

(54) FIXING DEVICE AND IMAGE FORMING APPARATUS INCORPORATING SAME

(71) Applicants: Yuuki Oka, Kanagawa (JP); Yukari Isoe, Kanagawa (JP); Motokazu Hasegawa, Kanagawa (JP)

(72) Inventors: Yuuki Oka, Kanagawa (JP); Yukari Isoe, Kanagawa (JP); Motokazu Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 14/226,110

(22) Filed: Mar. 26, 2014

(65) Prior Publication Data

US 2014/0305925 A1 Oct. 16, 2014

(30) Foreign Application Priority Data

Apr. 12, 2013 (JP) ..... 2013-083737

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/329
See application file for complete search history.

(56) References Cited

U.S. PATENT DOCUMENTS 5,427,938 A * 6/1995 Matsumura
6,063,321 A * 5/2000 Koyama
6,435,855 B1 * 8/2002 Sakurai
2006/0285893 A1 12/2006 Ishii
2009/0100911 A1 * 4/2009 Kawanishi et al.
2012/0155933 A1 6/2012 Hasegawa et al.
2012/0177418 A1 7/2012 Hashiyada et al.
2012/0230743 A1 9/2012 Matsusaka et al.

FOREIGN PATENT DOCUMENTS

JP 10171279 A * 6/1998
JP 2006-145949 6/2006
JP 2006-350054 12/2006
JP 2007-264021 10/2007
JP 2007264021 A * 10/2007
JP 2008093957 A * 4/2008
JP 2009-278749 11/2009
JP 2012-125931 7/2012
JP 2012-159829 8/2012

* cited by examiner

*Primary Examiner* — Walter L Lindsay, Jr.
*Assistant Examiner* — Milton Gonzalez
(74) *Attorney, Agent, or Firm* — Harness, Dickey & Pierce, P.L.C.

(57) ABSTRACT

A fixing device includes a fixing member, which includes heat-generating layer, and an induction heater to inductively heat the fixing member. The induction heater includes an excitation coil disposed facing an outer circumferential surface of the fixing member to generate a magnetic flux, a ferromagnetic core assembly containing a ferromagnetic core to form a magnetic path to direct the magnetic flux generated by the excitation coil to the fixing member, and a holder to hold the excitation coil and the ferromagnetic core assembly. The ferromagnetic core is insert-molded in and covered by the holder. The holder has a plurality of spherical marks created by a plurality of stabilizing members each having a spherical tip to stabilize the ferromagnetic core in a mold.

7 Claims, 13 Drawing Sheets

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119 to Japanese Patent Application No. 2013-083737, filed on Apr. 12, 2013, in the Japan Patent Office, the entire disclosure of which is hereby incorporated by reference herein.

BACKGROUND

Technical Field

Embodiments of this disclosure generally relate to a fixing device to fix an unfixed toner image onto a recording medium, and to an image forming apparatus incorporating the fixing device, such as a copier, a printer, a facsimile machine, or a multifunction machine having two or more of copying, printing, and facsimile capabilities.

Related Art

Image forming apparatuses, such as copiers or printers, typically incorporate a fixing device employing electromagnetic induction heating to reduce startup time of the image forming apparatuses, thereby enhancing the energy efficiency. Such a fixing device employing electromagnetic induction heating includes, e.g., a support roller (or heating roller) serving as a heat generator, an auxiliary fixing roller (or fixing roller), a fixing belt stretched over the support roller and the auxiliary fixing roller, an induction heating unit (or induction heater) facing the support roller via the fixing belt, and a pressing roller to contact the auxiliary fixing roller via the fixing belt. The induction heater includes, e.g., an excitation coil wound in a longitudinal direction of the induction heater, cores to direct an alternating magnetic flux arising from the excitation coil to the heat generator, and a holder (or coil guide) to hold the excitation coil and the cores.

The fixing belt is heated by the induction heater at a position where the fixing belt faces the induction heater. While a recording medium carrying a toner image passes through the auxiliary fixing roller and the pressing roller, the heated fixing belt heats the toner image formed on the recording medium, and accordingly, the toner image is fixed onto the recording medium.

Specifically, a high-frequency alternating current supplied to the excitation coil forms an alternating magnetic field around the excitation coil, which generates eddy currents on and around the surface of the support roller. When the eddy currents are generated around the support roller serving as a heat generator, the electrical resistance of the support roller leads to Joule heating of the support roller, thereby heating the fixing belt stretched over the support roller.

In such a fixing device employing the electromagnetic induction heating, the heat generator is directly heated by electromagnetic induction. Accordingly, compared to a typical fixing device using a halogen heater, the fixing device employing the electromagnetic induction heating has a higher heat-exchange efficiency and therefore the surface temperature of the fixing belt can be increased to a desired fixing temperature more efficiently, that is, with less energy and a shorter startup time.

To further enhance heat generation efficiency, it is effective to form a magnetic path that perfectly directs the magnetic flux arising from the excitation coil to the heat generator. Hence, for example, a side core that forms the magnetic path is insert-molded in the holder that holds the excitation coil so that ferromagnetic cores including the side core are exposed at the holder. With this configuration, the ferromagnetic cores can be positioned closer to the fixing member, thereby enhancing heating efficiency. However, when the side core is insert-molded in the holder, the side core may be broken if it is warped. Such a broken side core cannot evenly direct the magnetic flux to the heat generator, thus hampering uniform heating efficiency.

One approach to such side core breakage involves providing a side core having a center thicker than both ends, as with side core 64*a* illustrated in FIG. 20. Such a configuration reduces warping, thereby preventing the side core 64*a* from being broken when the side core 64*a* is insert-molded in a holder. However, in this case, the volume of the side core 64*a* is reduced by notches 64*b* as illustrated in FIG. 21, which is a side view of the side core 64*a* along a direction indicated by arrow Z in FIG. 20. The result is that heat generation efficiency is also decreased, with less magnetic flux directed by the side core 64*a*.

SUMMARY

In one embodiment of this disclosure, an improved fixing device includes a fixing member, which includes a heat-generating layer, and an induction heater to inductively heat the fixing member. The induction heater includes an excitation coil disposed facing an outer circumferential surface of the fixing member to generate a magnetic flux, a ferromagnetic core assembly containing a ferromagnetic core to form a magnetic path to direct the magnetic flux generated by the excitation coil to the fixing member, and a holder to hold the excitation coil and the ferromagnetic core assembly. The ferromagnetic core is insert-molded in and covered by the holder. The holder has a plurality of spherical marks created by a plurality of stabilizing members each having a spherical tip to stabilize the ferromagnetic core in a mold.

Also described is an image forming apparatus incorporating the fixing device.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
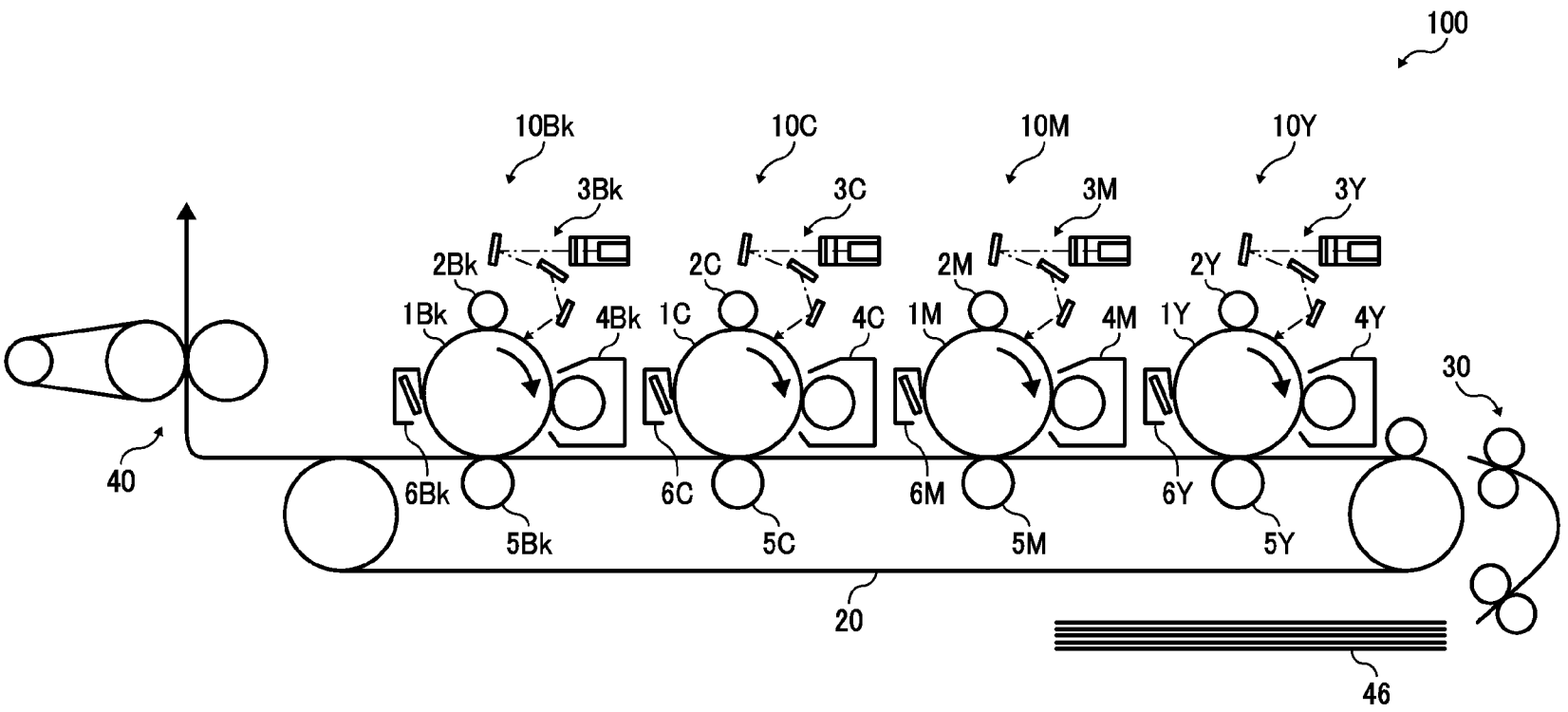
FIG. 1 is a schematic overall view of an image forming apparatus according to embodiments of this disclosure.

The accompanying drawings are intended to depict embodiments of this disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of this disclosure are not necessarily indispensable to the present invention.

In a later-described comparative example, embodiment, and exemplary variation, for the sake of simplicity like reference numerals will be given to identical or corresponding constituent elements such as parts and materials having the same functions, and redundant descriptions thereof will be omitted unless otherwise required.

Referring now to the drawings, wherein like reference numerals designate identical or corresponding parts throughout the several views, embodiments of this disclosure are described below.

Initially with reference to FIG. 1, a description is given of an entire configuration and operation of an image forming apparatus 100 according to the embodiments of this disclosure. It is to be noted that, in the following description, suffixes Y, M, C, and Bk denote colors yellow, magenta, cyan, and black, respectively, and may be omitted where unnecessary.

FIG. 1 is a schematic view of the image forming apparatus 100 according to the embodiments of this disclosure.

The image forming apparatus 100, herein serving as a printer, includes four imaging stations 10Y, 10M, 10C, and 10Bk serving as imaging units and employing an electrophotographic method. The imaging stations 10Y, 10M, 10C, and 10Bk include photoconductive drums 1Y, 1M, 1C, and 1Bk, serving as image carriers, respectively, and form toner images of yellow, magenta, cyan, and black on surfaces of the photoconductive drums 1Y, 1M, 1C, and 1Bk, respectively.

A conveyor belt 20 is disposed below the imaging stations 10Y, 10M, 10C, and 10Bk to convey a sheet 46, serving as a recording medium, through the imaging stations 10Y, 10M, 10C and 10Bk. The photoconductive drums 1Y, 1M, 1C, and 1Bk of the respective imaging stations 10Y, 10M, 10C and 10Bk are disposed to rotatably contact the conveyor belt 20. The sheet 46 electrostatically adheres to an outer surface of the conveyor belt 20.

It is to be noted that the four imaging stations 10Y, 10M, 10C, and 10Bk have identical configurations, differing only in the color of toner employed. Hence, a description is herein given only of the imaging station 10Y employing the yellow color, which is disposed at the extreme upstream end in a direction in which the sheet 46 is conveyed, as a representative example of the imaging stations 10Y, 10M, 10C and 10Bk. Specific descriptions of the imaging stations 10M, 10C and 10Bk are herein omitted, unless otherwise required.

The imaging station 10Y includes the photoconductive drum 1Y disposed substantially at a center of the imaging station 10Y. The photoconductive drum 1Y rotatably contacts the conveyor belt 20. The photoconductive drum 1Y is surrounded by various pieces of imaging equipment, such as a charging device 2Y, an exposure device 3Y, a developing device 4Y, a transfer roller 5Y, a drum cleaner 6Y, and a charge neutralizing device, disposed sequentially along a direction of rotation of the photoconductive drum 1Y. The charging device 2Y charges the surface of the photoconductive drum 1Y so that a predetermined electric potential is created on the surface of the photoconductive drum 1Y. The exposure device 3Y directs light to the charged surface of the photoconductive drum 1Y according to an image signal after color separation to form an electrostatic latent image on the surface of the photoconductive drum 1Y. The developing device 4Y develops the electrostatic latent image thus formed on the surface of the photoconductive drum 1Y with yellow toner, thereby forming a visible image, also known as a toner image, in this case of the color yellow. The transfer roller 5Y serving as a transfer device transfers the toner image thus developed onto the sheet 46 conveyed by the conveyor belt 20. The drum cleaner 6Y removes residual toner remaining on the surface of the photoconductive drum 1Y after a transfer process. The charge neutralizing device removes residual charge from the surface of the photoconductive drum 1Y. A similar process is carried out at each of the other imaging stations to form a full-color toner image on the sheet 46.

A sheet-feeding unit 30 is disposed to the right of the conveyor belt 20, at a bottom right in FIG. 1, to feed the sheet 46 onto the conveyor belt 20.

In addition, a fixing device 40, described below in detail, is disposed to the left of the conveyor belt 20 in FIG. 1. The sheet 46 conveyed by the conveyor belt 20 is then continuously conveyed to the fixing device 40 through a conveyance path, which extends from the conveyor belt 20 through the fixing device 40.

The fixing device 40 applies heat and pressure to the sheet 46 thus conveyed, on a surface of which the toner images of yellow, magenta, cyan, and black are transferred. Thus, the fixing device 40 fuses the toner images of yellow, magenta, cyan, and black so that the toner images of yellow, magenta, cyan, and black permeate the sheet 46, thereby fixing the toner images of yellow, magenta, cyan, and black onto the sheet 46. The sheet P thus passes through the fixing device 40 and is then discharged by a pair of discharging rollers (not shown) disposed downstream from the fixing device 40 on the conveyance path. Thus, a series of image formation processes is completed.

Figure 2:
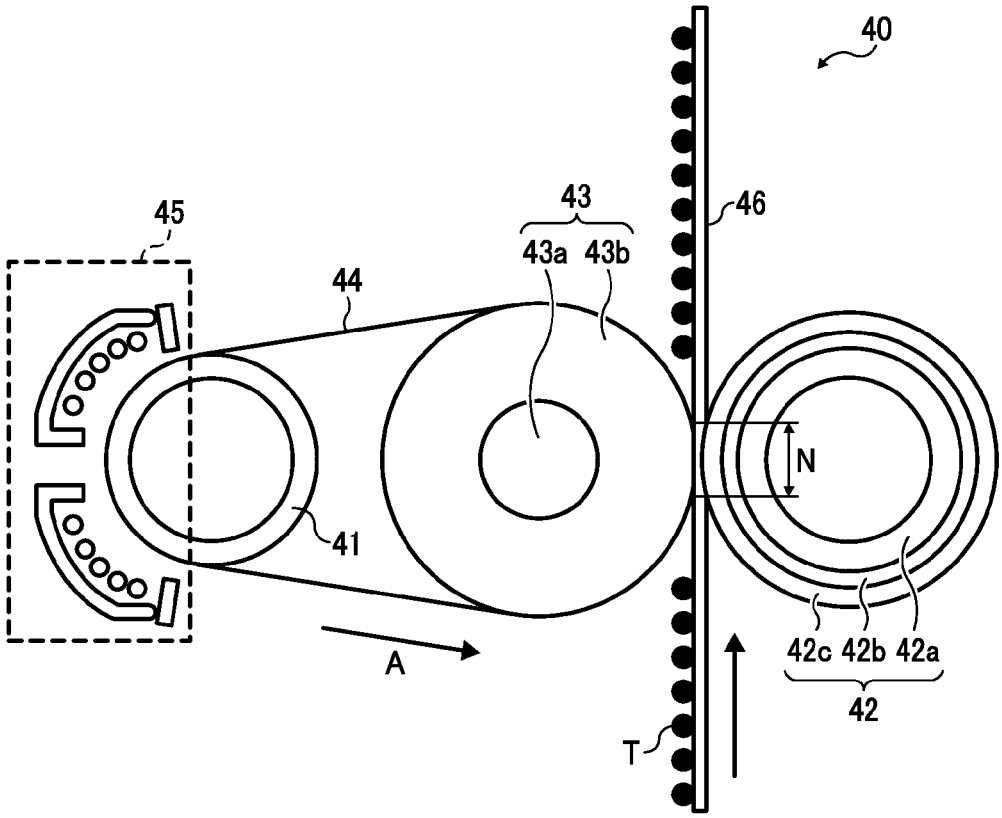
FIG. 2 is a schematic sectional view of a fixing device incorporated in the image forming apparatus of FIG. 1.

Referring now to FIG. 2, a description is given of the fixing device 40 according to an embodiment.

FIG. 2 is a schematic view of the fixing device 40 incorporated in the image forming apparatus 100 described above.

The fixing device 40 is a belt-type fixing device. The fixing device 40 includes, e.g., a heating roller (or support roller) 41 serving as a fixing member including a heat-generating layer, a fixing roller 43, a fixing belt 44 stretched over the heating roller 41 and the fixing roller 43, an induction heater 45 facing the heating roller 41 via the fixing belt 44, and a pressing roller 42 to contact the fixing roller 43 via the fixing belt 44, that is, to contact the outer surface of the fixing belt 44, opposite the fixing roller 43, with the fixing belt 44 sandwiched therebetween. The fixing belt 44 rotates in a direction indicated by arrow A. A toner image T carried by the sheet 46 is fixed onto the sheet 46 under heat and pressure while the sheet 46 passes between the pressing roller 42 and the fixing roller 43 on the conveyor belt 20.

The heating roller 41 is a nonmagnetic stainless steel roller having a metal core layer with a thickness of about 0.2 mm to about 1 mm. A surface of the metal core of the heating roller 41 is covered by a heat-generating layer made of copper (Cu) having a thickness of about 3 μm to about 20 μm to enhance heat generation efficiency. In such a case, preferably, the copper (Cu) layer may be nickel-plated to prevent rust. A ferrite core may be disposed inside the heating roller 41 to enhance the heat generation efficiency.

Alternatively, the heating roller 41 may be made of a magnetic shunt alloy having a Curie point of about 160° C. to about 220° C. An aluminum member may be disposed inside the magnetic shunt alloy to stop a temperature rise around the Curie point. The heating roller 41 made of the magnetic shunt alloy may be covered by a nickel-plated copper (Cu) layer to enhance the heat generation efficiency.

The fixing roller 43 is constructed of a metal core 43*a* and an elastic member 43*b*. The metal core 43*a* is, e.g., stainless steel or carbon steel. The elastic member 42*b* is, e.g., solid or foam heat-resistant silicone rubber, and coats the metal core 43*a*. The fixing roller 43 and the pressing roller 42 contact each other, via the fixing belt 44, with pressure applied by the pressing roller 42, thereby forming an area of contact herein called a fixing nip N having a predetermined width. The fixing roller 43 has an outer diameter of about 30 mm to about 40 mm. The elastic member 43*b* has a thickness of about 3 mm to about 10 mm and a JIS-A hardness of about 10° to about 50°.

Figure 3:
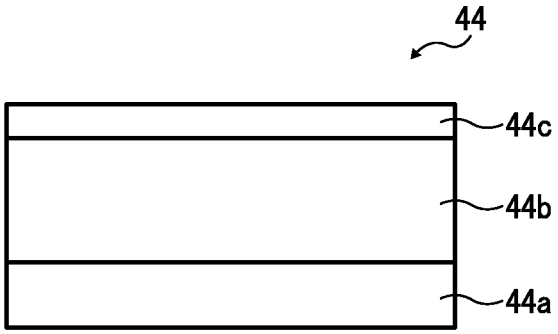
FIG. 3 is a partial sectional view of a fixing belt incorporated in the fixing device of FIG. 2.

Referring now to FIG. 3, a detailed description is given of the fixing belt 44.

FIG. 3 is a partial sectional view of the fixing belt 44 incorporated in the fixing device 40 described above.

The fixing belt 44 is constructed of a substrate 44*a*, an elastic layer 44*b* and a release layer 44*c*. As illustrated in FIG. 3, the elastic layer 44*b* rests on the substrate 44*a*, and the release layer 44*c* rests on the elastic layer 44*b*.

The substrate 44*a* has mechanical strength and flexibility when the fixing belt 44 is stretched, and heat resistance at a fixing temperature. According to the present embodiment, the heating roller 41 is inductively heated. Hence, the substrate 44*a* is preferably made of an insulating heat-resistant resin material such as polyimide, polyimide-amide, polyether-ether ketone (PEEK), polyether sulfide (PES), polyphenylene sulfide (PPS), or fluorine resin. The substrate 44*a* preferably has a thickness of about 30 μm to about 200 μm for heat capacity and strength.

The elastic layer 44*b* is employed to give flexibility to the outer surface of the fixing belt 44 to obtain a uniform image without uneven glossiness. Hence, the elastic layer 44*b* is preferably made of an elastomer material having a JIS-A hardness of about 5° to about 50° and a thickness of about 50 μm to about 500 μm. The elastic layer 44*b* is made of, e.g., silicone rubber or fluorosilicone rubber for heat resistance at the fixing temperature.

The release layer 44*c* is made of, e.g., fluorine resin such as tetrafluoride ethylene resin (PTFE), tetrafluoride ethylene-perfluoroalkyl vinylether copolymer resin (PFA) or tetrafluoride ethylene-hexafluoride propylene copolymer (FEP), combinations of the foregoing resin materials, or heat-resistant resin in which the foregoing fluorine resin is dispersed.

The release layer 44*c* coating the elastic layer 44*b* enhances toner releasability without using silicone oil, thereby preventing paper dust from adhering to the fixing belt 44 and realizing an oil-less system. However, the resin having good releasability does not typically have elasticity like that of a rubber material. Accordingly, if a thick release layer 44*c* is formed on the elastic layer 44*b*, the flexibility of the outer surface of the fixing belt 44 might be lost to an extent, causing uneven glossiness. To strike a good balance between flexibility and releasability, the release layer 44*c* has a thickness of about 5 μm to about 50 μm, and preferably about 10 μm to about 30 μm.

Optionally, a primer layer may be provided between the foregoing layers. A durable layer may be provided on an inner surface of the substrate 44*a* to enhance sliding durability against the heating roller 41 and the fixing roller 43.

Preferably, a heat-generating layer may be formed on the substrate 44*a*. For example, a copper (Cu) layer having a thickness of about 3 μm to about 15 μm may be formed on a base layer of, e.g., polyimide to be used as the heat-generating layer.

Returning to FIG. 2, the pressing roller 42 is constructed of a cylindrical metal core 42*a*, a high heat-resistant elastic layer 42*b*, and a release layer 42*c*. The pressing roller 42 presses the fixing roller 43 via the fixing belt 44 to form the fixing nip N therebetween. The pressing roller 42 has an outer diameter of about 30 mm to about 40 mm. The elastic layer 42*b* has a thickness of about 0.3 mm to about 5 mm and an Asker hardness of about 20° to about 50°. The elastic layer 42*b* is made of a heat-resistant material such as silicone rubber. In addition, the release layer 42*c* made of fluorine resin having a thickness of about 10 μm to about 100 μm is formed on the elastic layer 42*b* to enhance releasability upon two-sided printing operation.

The pressing roller 42 is configured to be harder than the fixing roller 43. Accordingly, the pressing roller 42 presses and deforms the fixing roller 43 and the fixing belt 44 into a recess at the fixing nip N. Such recess gives a curvature to the sheet 46 sufficient to prevent the sheet 46 from hugging the surface of the fixing belt 44 when the sheet 46 exits the fixing nip N. Thus, the releasability of the sheet 46 can be enhanced.

Figure 4:
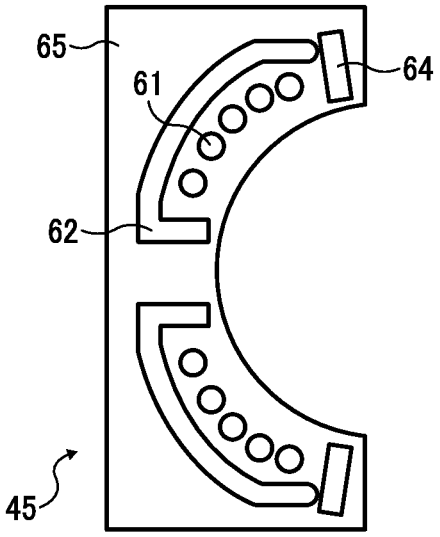
FIG. 4 is a vertical sectional view of an induction heater incorporated in the fixing device of FIG. 2.
Figure 5:
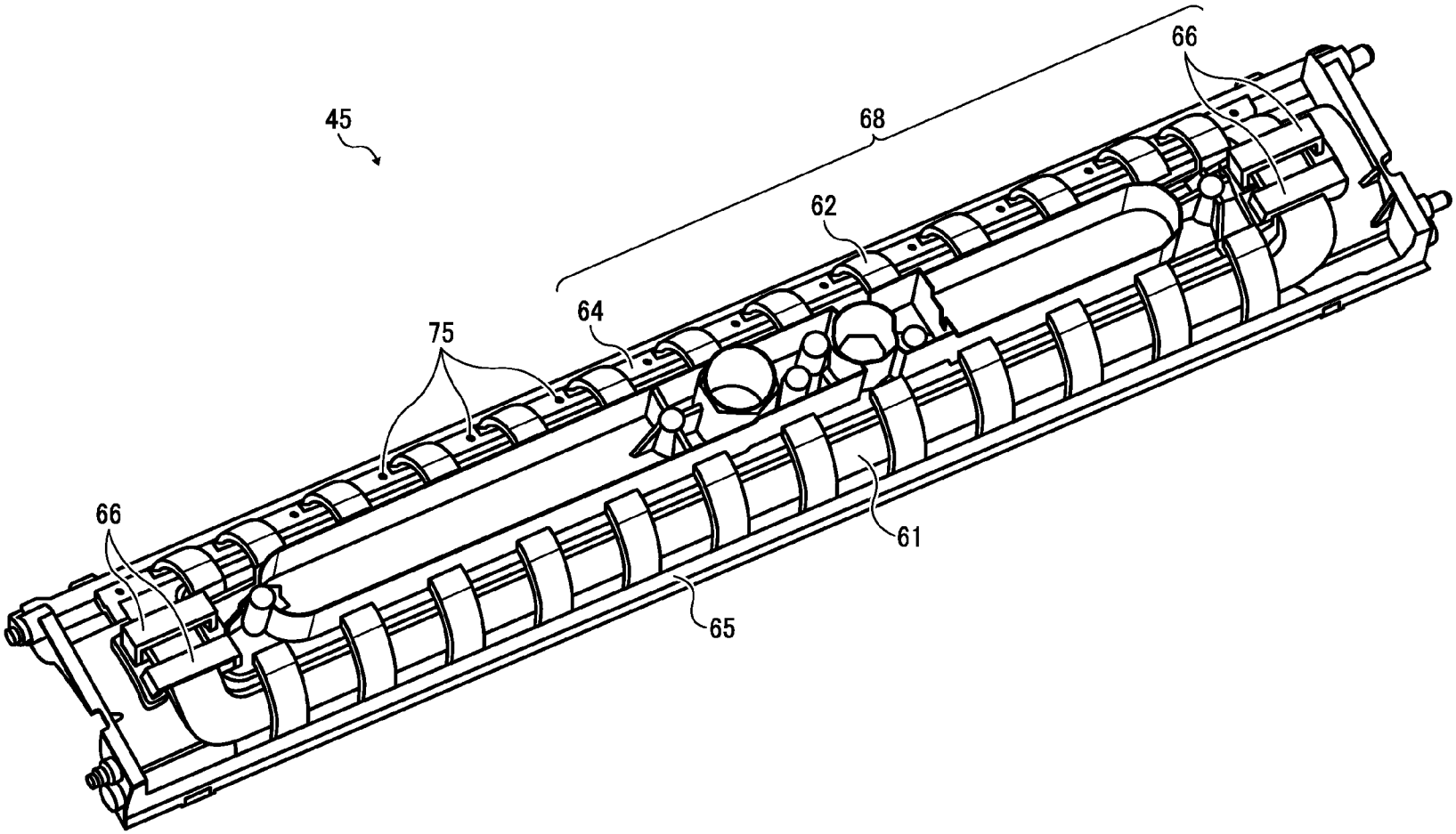
FIG. 5 is a perspective view of the induction heater of FIG. 4.

Referring now to FIGS. 4 and 5, a description is given of the induction heater 45.

FIG. 4 is a vertical sectional view of the induction heater 45 incorporated in the fixing device 40 described above. FIG. 5 is a perspective view of the induction heater 45.

The induction heater 45 includes an excitation coil 61, a ferromagnetic core assembly 68, and a case 65. The excitation coil 61 is disposed facing an outer circumferential surface of the heating roller 41 to generate interlinkage, magnetic flux toward the heating roller 41. The ferromagnetic core assembly 68 includes ferromagnetic cores to form a continuous magnetic path to direct the magnetic flux arising from the excitation coil 61 to the heating roller 41. The case 65, serving as a holder, holds the excitation coil 61 and the ferromagnetic core assembly 68.

As illustrated in FIGS. 4 and 5, the ferromagnetic core assembly 68 includes the ferromagnetic cores such as arch cores 62, side cores 64 and end cores 66. The arch cores 62 are disposed facing the outer circumferential surface of the heating roller 41 with the excitation coil 61 interposed therebetween. The side cores 64 are disposed facing the outer circumferential surface of the heating roller 41 without the excitation coil 61 interposed therebetween. The side cores 64 also contact the arch cores 62. The end cores 66 are disposed astride each end of the excitation coil 61 in an axial direction of the heating roller 41, that is, longitudinal direction of the induction heater 45. The ferromagnetic core assembly 68 surrounds the excitation coil 61, thereby forming a closed magnetic circuit to direct the magnetic flux arising from the excitation coil 61 to the heating roller 41 and the fixing belt 44. Thus, a magnetic circuit is reliably formed as a closed circuit, thereby enhancing the heat generation efficiency of the heating roller 41 and the fixing belt 44. The side cores 64 are insert-molded in the case 65.

As illustrated in FIG. 5, twelve arch cores 62 are disposed in the case 65, having an end contacting the side cores 64. The twelve arch cores 62 and the side cores 64 surround the excitation coil 61.

The excitation coil 61 is prepared by 5-15 windings of a Litz wire. The Litz wire is constructed of about 50 to about 500 conductive wire strands, individually insulated and twisted together. Each conductive wire strand has a diameter of about 0.05 mm to about 0.2 mm. The excitation coil 61 extends in the case 65, across an entire maximum heating area of the heating roller 41, and generates the interlinkage, magnetic flux toward the heating roller 41. A fusion layer is provided on a surface of the Litz wire. The fusion layer is stiffened by applying heat either by means of supplying power or in a thermostatic oven. Accordingly, the shape of the excitation coil 61 can be maintained. Alternatively, the excitation coil 61 may be prepared by winding a Litz wire without a fusion layer, and press-molding the wound Litz wire to reliably maintain the shape of the excitation coil 61. To provide the Litz wire with heat resistance at the fixing temperature or higher, resin having insulation performance and heat resistance, such as polyamide-imide or polyimide, may be used as an insulation material to coat the Litz wire.

The windings of the excitation coil 61 are glued to the case 65 with an adhesive, e.g., silicone glue. To ensure heat resistance at the fixing temperature or higher, the case 65 is made of e.g., a high heat-resistant resin material such as resin polyethylene terephthalate (PET), polyphenylene sulfide (PPS), or liquid crystal polymers (LCP).

Each of the ferromagnetic cores, namely, the arch cores 62, the side cores 64 and the end cores 66, is made of a ferrite material such as a manganese-zinc (Mn—Zn) ferrite material or a nickel-zinc (Ni—Zn) ferrite material.

The plurality of side cores 64 are arranged side by side in the axial direction of the heating roller 41, that is, longitudinal direction of the induction heater 45 to minimize warping of the side cores 64 during a sintering process that contracts the ferrite material.

The end cores 66 are disposed at each end of the excitation coil 61 in the longitudinal direction of the induction heater 45 to increase the temperature of each end of the heating roller 41, thereby preventing a temperature decrease at each end of the sheet 46 while the sheet 46 passes through the fixing nip N. If the temperature is sufficiently uniform in the fixing nip N, the end cores 66 may be omitted.

A description is now given of operation of the fixing device 40 configured as described above.

Returning to FIG. 2, the fixing belt 44 rotates in the direction indicated by arrow A, driven by a drive motor. The heating roller 41 is inductively heated by the induction heater 45, and thus heats the fixing belt 44.

Specifically, by supplying a high-frequency alternating current in a range from 10 kHz to 1 MHz to the induction heater 45, magnetic lines are generated within a loop of the excitation coil 61 in a manner such that the magnetic lines alternately switch direction. Thus, an alternating magnetic field is formed. The alternating magnetic field generates eddy currents, and accordingly causes Joule heating of the heating roller 41. Thus, the heating roller 41 is inductively heated. The heating roller 41 thus heated releases heat to the fixing belt 44. The fixing belt 44 thus heated contacts the sheet 46 in the fixing nip N to heat and fuse the toner image T formed on the sheet 46. Consequently, the toner image T is fixed onto the sheet 46 while the sheet 46 passes through the fixing nip N.

Referring now to FIGS. 6 to 10, a description is given of how the side cores 64 are insert-molded in the case 65.

Figure 6:
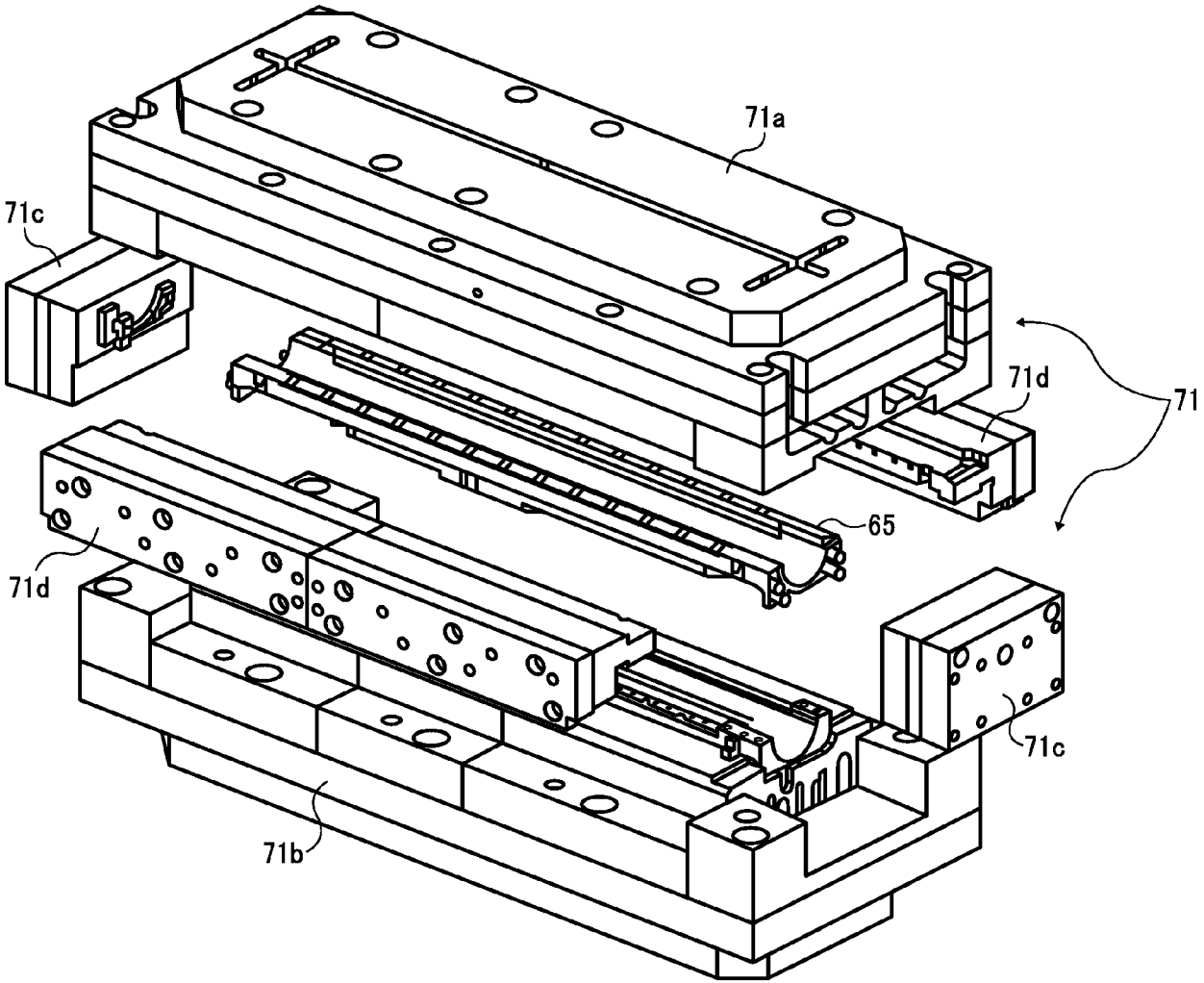
FIG. 6 is a perspective view of a mold and a case.

FIG. 6 is a perspective view of a mold 71 and the case 65.

Fused resin is poured into the mold 71 and cooled to be cast. Thus, the case 65 is shaped as illustrated in FIG. 6. The mold 71 includes a stationary part 71*a* and a movable part 71*b*. The resin is poured into the stationary part 71*a*. The mold 71 also includes end parts 71*c* and side parts 71*d*. The end parts 71*c* and the side parts 71*d* are interposed between the stationary part 71*a* and the movable part 71*b*. The end parts 71*c* shape ends of the case 65 in a longitudinal direction thereof. The side parts 71*d* shape sides of the case 65, perpendicular to the longitudinal direction thereof.

Figure 7:
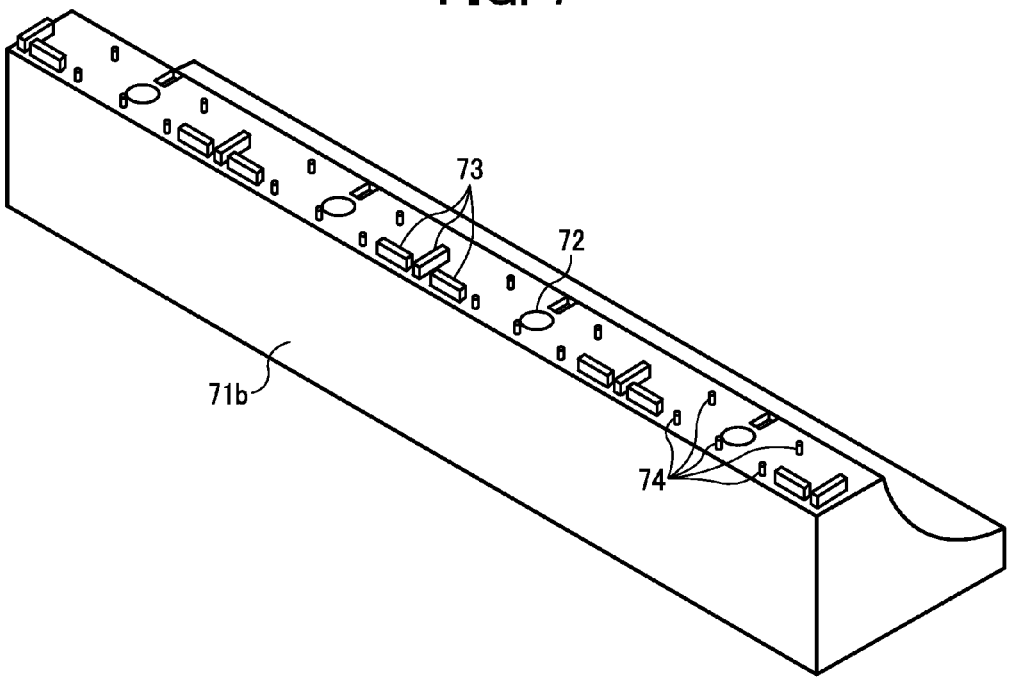
FIG. 7 is a partially enlarged view of a movable part of the mold of FIG. 6.
Figure 8:
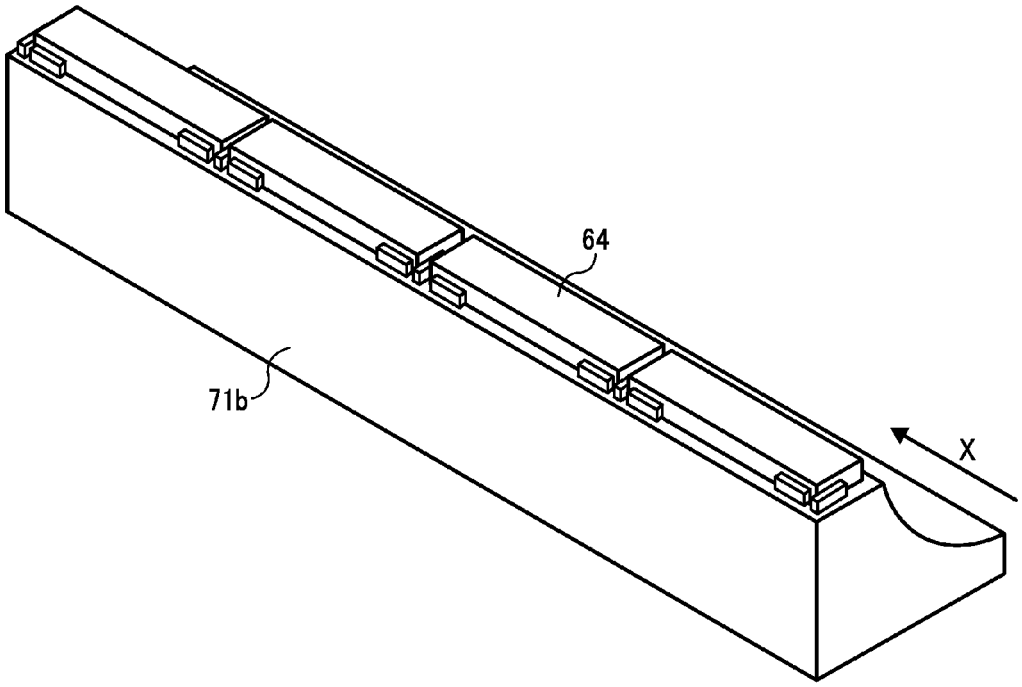
FIG. 8 is another partially enlarged view of the movable part, with side cores mounted thereon.

FIG. 7 is a partially enlarged view of the movable part 71*b*. FIG. 8 is another partially enlarged view of the movable part 71*b*, on which the side cores 64 are disposed.

The movable part 71*b* includes magnets 72, guide pins 73, and spherical pins 74 to stabilize the side core 64 in the mold 71 so that the side cores 64 are insert-molded in the case 65. The spherical pins 74 serve as stabilizing members. As illustrated in FIG. 8, the side cores 64 are disposed on the spherical pins 74 while positioned by the guide pins 73.

Figure 9:
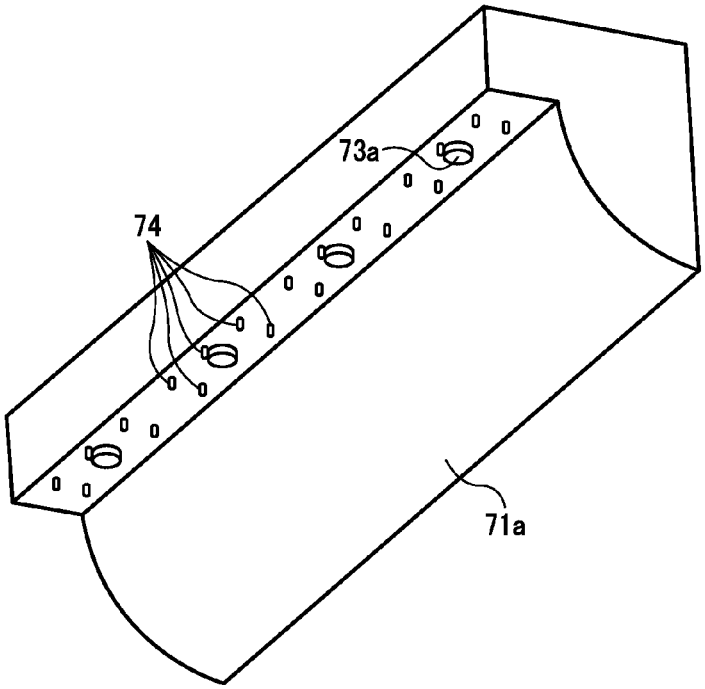
FIG. 9 is a partially enlarged view of a stationary part of the mold of FIG. 6.

FIG. 9 is a partially enlarged view of the stationary part 71*a*.

The stationary part 71*a* includes guide pins 73*a*, and spherical pins 74, serving as stabilizing members, at positions corresponding to the spherical pins 74 of the movable part 71*b*.

Figure 10:
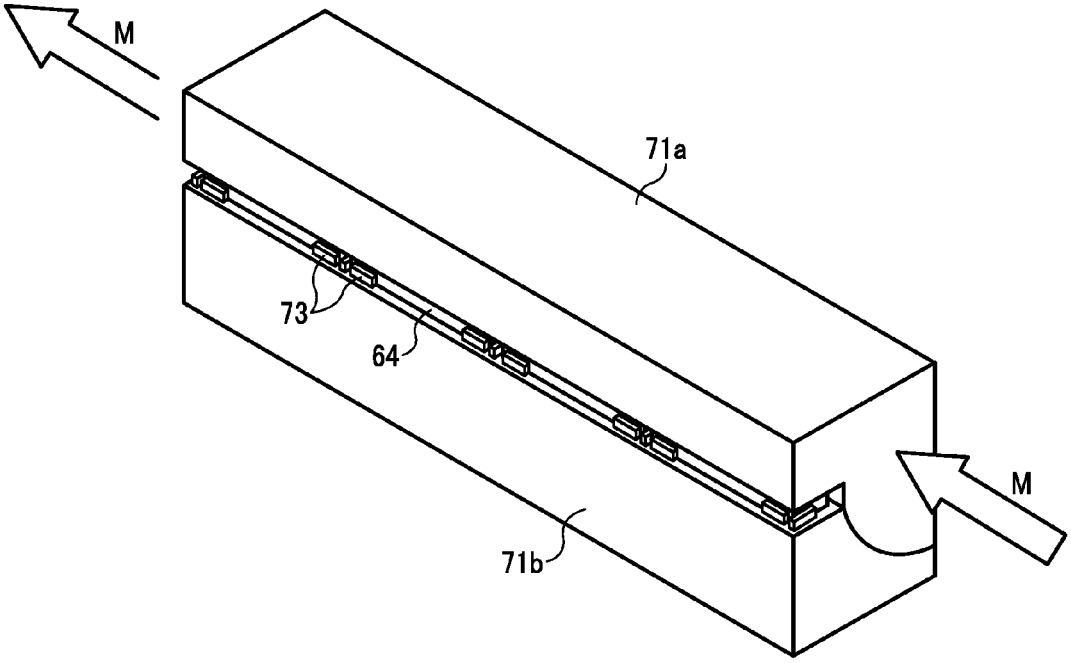
FIG. 10 is a perspective view of the mold during a shaping process.

FIG. 10 is a perspective view of the mold 71 coupled to the side cores 64.

As illustrated in FIG. 10, when the stationary part 71*a* and the movable part 71*b*, having a complementary shape, are coupled to each other, each of the side cores 64 is vertically held and perfectly stabilized by the spherical pins 74 at three or more positions, in this case at five positions. Thus, a gap corresponding to the shape of the case 65 is formed.

While top and bottom sides of each of the side cores 64 are stabilized by the spherical pins 74, as described above, right and left sides thereof are also stabilized by pins. Accordingly, the side cores 64 are stabilized without directly contacting the mold 71. Thus, the gap is formed between the side cores 64 and the mold 71, through which the resin flows. The fused resin is poured into the mold 71 in a direction indicated by arrow M and cast. Thus, the case 65 is formed with the side cores 64 insert-molded in the case 65 so that the side cores 64 are covered by the resin of the case 65. Although the resin is poured into the mold 71 at a high speed and with a high pressure, the side cores 64 are not moved by the flowing resin because the side cores 64 are stabilized at desired positions by, e.g., the spherical pins 74.

Accordingly, the case 65 has five spherical pin marks 75, serving as spherical marks, on at least the top and bottom sides of each of the side cores 64, respectively, at positions where the spherical pins 74 stabilize the side cores 64 during the shaping process. As described above, the side cores 64 are covered by the resin. Therefore, even if the side cores 64 are broken due to repeated cycling of high and low temperature conditions, scattering of broken pieces of the side cores 64 can be prevented.

Figure 11:
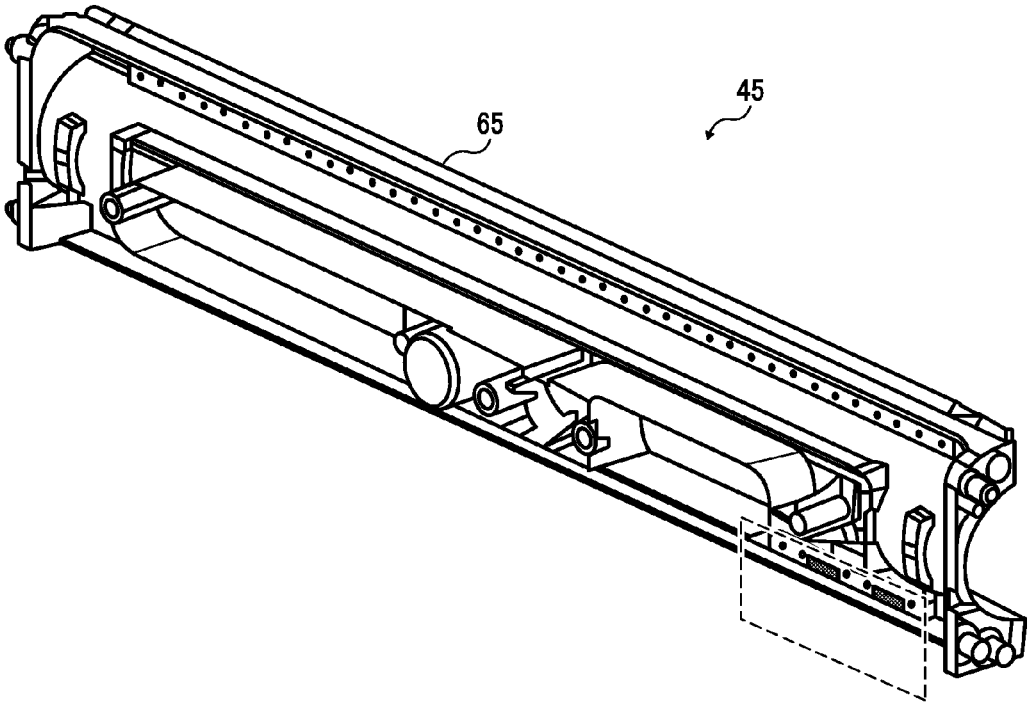
FIG. 11 is a perspective view of the induction heater of FIG. 4, illustrating an outer side of the case after the shaping process.
Figure 12:
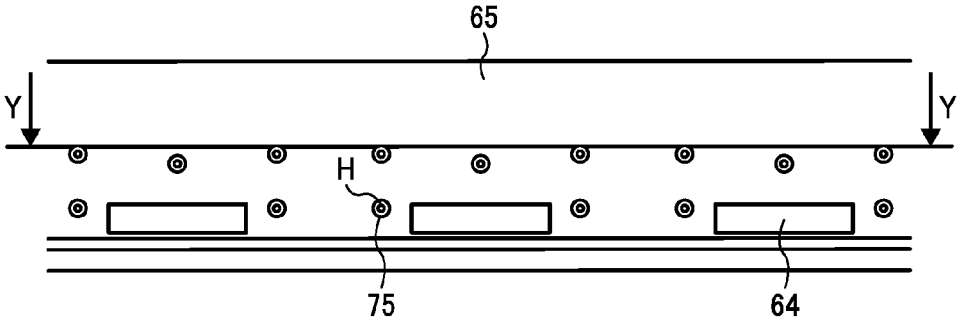
FIG. 12 is a partially enlarged view of the induction heater of FIG. 11.
Figure 13:
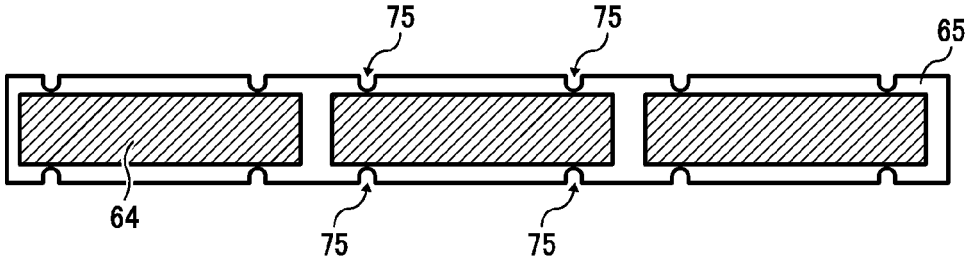
FIG. 13 is a sectional view of the case of FIG. 12.

Referring now to FIGS. 11 to 13, a description is given of the spherical pin marks 75 remaining on the case 65 after the shaping process, in which the side cores 64 are stabilized by the spherical pins 74 as described above.

As described above, each of the stationary part 71*a* and the movable part 71*b* includes five spherical pins 74, by which at least the top and bottom sides of the side cores 64 are stabilized.

FIG. 11 is a perspective view of the induction heater 45, illustrating an outer side of the case 65, which does not face the heating roller 41, after the shaping process. FIG. 12 is a partially enlarged view of the induction heater 45, illustrating an area surrounded by a dotted line in FIG. 11. FIG. 13 is a sectional view of the case 65 after the shaping process, along a direction indicated by arrow Y in FIG. 12.

As illustrated in FIG. 12, after the shaping process, the outer side of the case 65 has a plurality of spherical pin marks 75, and more specifically, five spherical pin marks 75 corresponding to the five spherical pins 74 on each of the side cores 64.

Each of the spherical pin marks 75 has a hole H in the bottom, at the center inside each of the spherical pin marks 75. The hole H is not covered by the resin. Accordingly, each of the side cores 64 is exposed at the holes H. The holes H are created because the resin does not enter contact positions between the spherical pins 74 and the side cores 64. The holes H become obvious when the case 65 is removed from the spherical pins 74 and the mold 71 after the shaping process. However, the holes H created inside the spherical pin marks 75 are very small because the spherical pins 74 contact the side cores 64 substantially at a point. Such a point contact between the spherical pins 74 and the side cores 64 prevents broken pieces of the side cores 64 from falling through the holes H even if the side cores 64 deteriorate and are broken over time after the shaping process of the case 65 due to different coefficients of thermal expansion of the side cores 64 and the resin. Thus, covering the spherical pin marks 75 can be obviated after the shaping process of the case 65. That is, additional processes or changes to the processes are obviated, and therefore, productions costs are not increased. It is to be noted that the size of the spherical pins 74 and spring force thereof, described later with reference to FIG. 17, can be appropriately adjusted to reliably stabilize the side cores 64 having various shapes after a sintering process. The spherical pins 74 and the spherical pin marks 75 do not necessarily have a perfect spherical shape as long as the spherical pins 74 and the spherical pin marks 75 have a round shape sufficient to achieve the above-described effects. According to the embodiments of this disclosure, the spherical pin marks 75 include a mark created by a comparative pin having a spherical tip (e.g., hemispherical tip).

FIG. 12 illustrates three side cores 64 after the shaping process, arranged in the axial direction of the heating roller 41. The three side cores 64 are separately formed with individual sizes, and then sintered. Alternatively, one side core with a length covering a plurality of side cores may be sintered, and then divided into the plurality of side cores having individual sizes.

Figure 19:
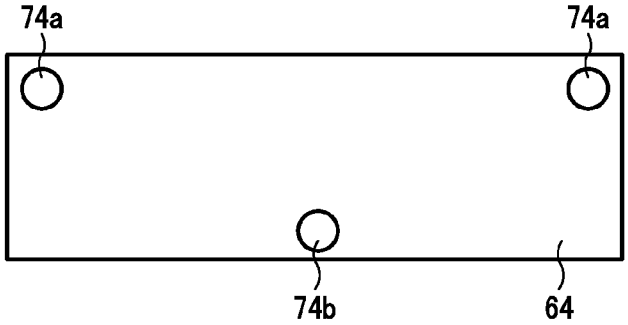
FIG. 19 is a plan view of the side core stabilized by spherical pins, illustrating arrangement of the spherical pins.

The outer side of the case 65 has open portions after the shaping process. The side cores 64 having a rectangular shape are exposed at the open portions, respectively, so that the side cores 64 contact the arch cores 62, respectively, as illustrated in FIG. 4. In other words, each of the side cores 64 is covered by the case 65 except portions exposed at the corresponding open portion of the outer side of the case 65 and at the holes H inside the spherical pin marks 75. Before being processed, each of the side cores 64 has a relatively flat surface, which is exposed at the open portion. Each of the arch cores 62 is glued to the corresponding side core 64 with, e.g., an adhesive. In FIG. 4, each of the arch cores 62 has a round end contacting the corresponding side core 64. However, the shape of the end contacting the side core 64 is not limited to the round shape. The arch cores 62 and the side cores 64 contact each other, thereby obtaining a high heat generation efficiency of the heating roller 41. Contact areas between the arch cores 62 and the side cores 64 are relatively large because the arch cores 62 contact the respective flat surfaces of the side cores 64. Accordingly, the heat generation efficiency of the heating roller 41 is enhanced. It is to be noted that each of the side cores 64 is herein stabilized at five points upwardly and downwardly, respectively. Alternatively, each of the side cores 64 may be stabilized at the three points of a triangle as illustrated in FIG. 19.

As illustrated in FIG. 13, the three side cores 64 are separately arranged in the axial direction of the heating roller 41, and surrounded by the resin of the case 65. The spherical pin marks 75 are formed on the top and bottom sides of each of the side cores 64. The spherical pin marks 75 formed on the top side of each of the side cores 64 are positioned corresponding to the spherical pin marks 75 formed on the bottom side of each of the side cores 64 because the stationary part 71*a* includes the spherical pins 74 positioned corresponding to the spherical pins 74 of the movable part 71*b*. In this configuration, the side cores 64 are interposed between the spherical pins 74 of the stationary part 71*a* and the spherical pins 74 of the movable part 71*b*. Accordingly, the side cores 64 are stabilized without receiving an unnecessary force, and therefore, the side cores 64 are rarely broken. Alternatively, the spherical pins 74 of the stationary part 71*a* may be disposed at positions not corresponding to the positions where the spherical pins 74 of the movable part 71*b* are disposed.

Figure 20:
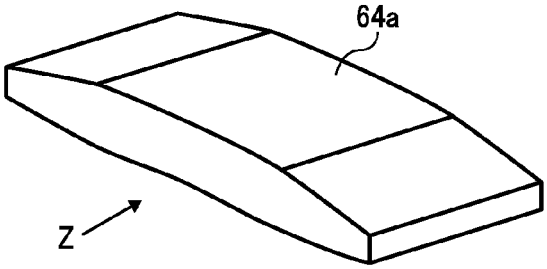
FIG. 20 RELATED ART
FIG. 20 is a perspective view of a typical side core having a center thicker than both ends.

Inside the mold 71, three or more spherical pins 74 stabilize one side of each of the side cores 64. The typical side core 64*a* illustrated in FIG. 20 has a shape causing loss of magnetic flux because its volume is reduced by the notches 64*b*. By contrast, according to the embodiments of this disclosure, the side cores 64 do not necessarily have such notches that reduce the volume of the side cores 64, yet even if the side cores 64 are warped, the side cores 64 are rarely broken in the mold 71.

Figure 14:
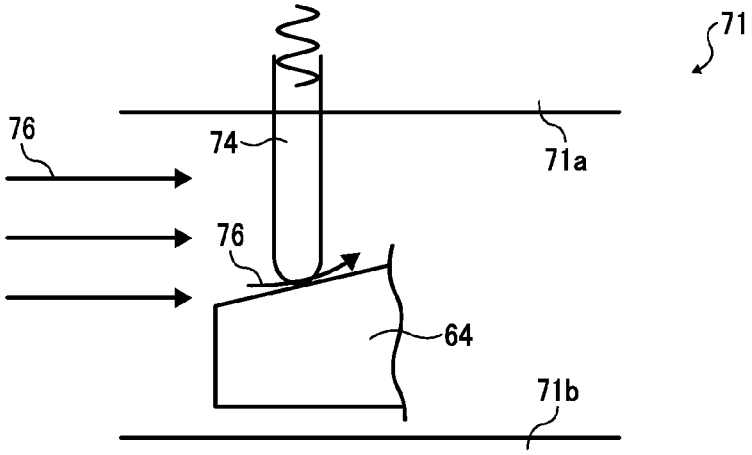
FIG. 14 is a side view of the mold of FIG. 6, illustrating an inside thereof with a spherical pin.
Figure 15:
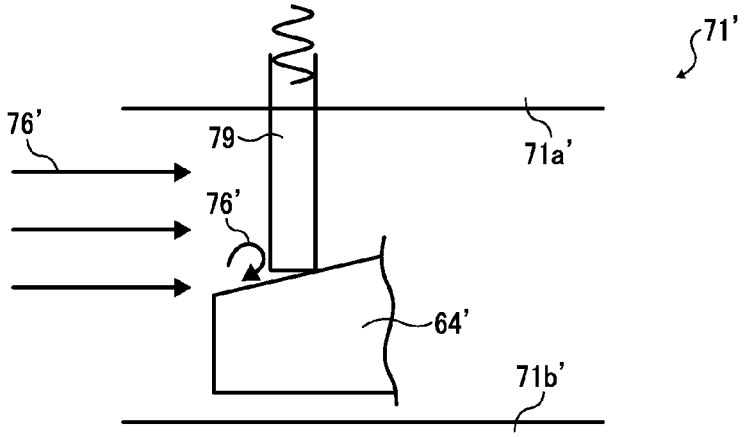
FIG. 15 is a side view of a comparative mold, illustrating an inside thereof with a comparative pin.
Figure 16:
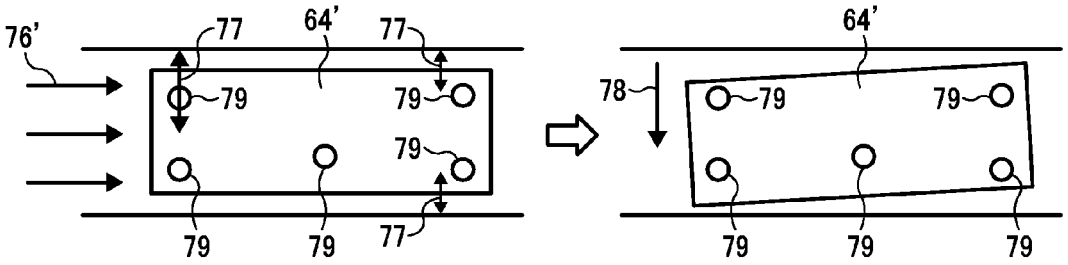
FIG. 16 is a plan view of the side core stabilized by the spherical pins, illustrating direction of forces applied to the side core and the spherical pins.

Referring now to FIGS. 14 to 16, a description is given of effects obtained by the spherical pins 74 that stabilize the side cores 64.

FIG. 14 is a side view of the mold 71, illustrating an inside thereof with a spherical pin 74 pressed against the side core 64.

Even if the side core 64 contacts the spherical pin 74 at an angle as illustrated in FIG. 14, the spherical pin 74 can stabilize the side core 64. The angle can be any angle as long as it is a realistic angle. By using the spherical pin 74 having a spherical tip, flowability of the resin flowing around the spherical tip as indicated by arrows 76 is enhanced. Accordingly, the side core 64 is rarely broken.

FIG. 15 is a side view of a mold 71', illustrating an inside thereof with a comparative pin 79 pressed against a side core 64'.

As illustrated in FIG. 15, the comparative pin 79 is herein a pin having a cylindrical tip. If the comparative pin 79 is used instead of the spherical pin 74 having a spherical tip, and the side core 64' contacts the comparative pin 79 at an angle, a wedge-shaped gap is created between the comparative pin 79 and the side core 64' because a corner of the comparative pin 79 contacts the side core 64'. The gap degrades flowability of the resin that surrounds the side core 64' as indicated by arrows 76' during a shaping process of the side core 64'. The degraded flowability vertically stresses the side core 64', which may break the side core 64'.

FIG. 16 is a plan view of the side core 64' with comparative pins 79, illustrating directions of forces applied to the side core 64' and the comparative pins 79.

As illustrated in FIG. 16, when the comparative pins 79 are stressed in a lateral direction, that is, direction indicated by arrows 77, due to the degraded flowability, the side core 64' may be moved in a direction indicated by an arrow 78, resulting in decrease in the heating efficiency and unevenness of temperature distribution. If the comparative pins 79 are pressed hard against the side core 64' to prevent movement of the side core 64', the side core 64' may be broken.

Figure 17A:
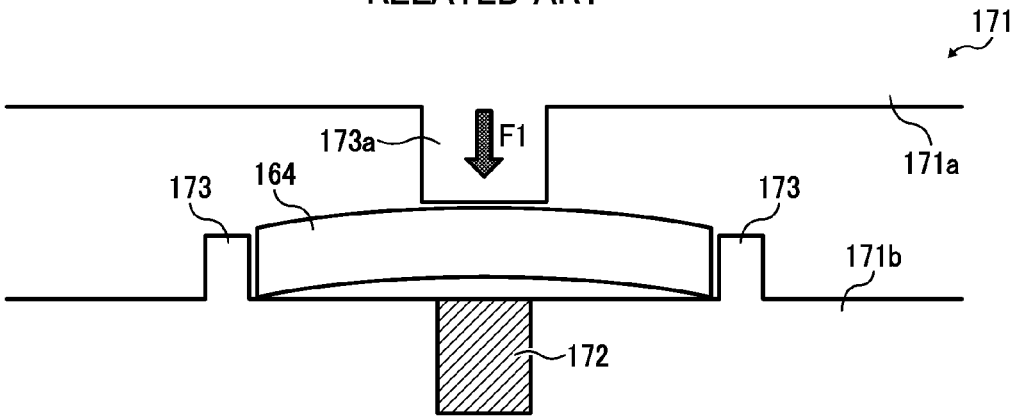
FIG. 17A RELATED ART
FIG. 17A is a side view of a side core stabilized in a comparative way.
Figure 17B:
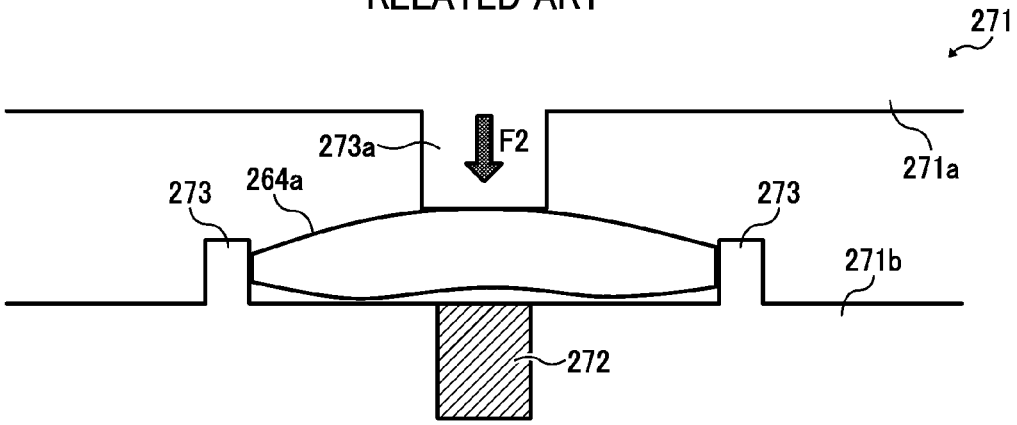
FIG. 17B RELATED ART
FIG. 17B is a side view of another side core stabilized in the comparative way.

Referring now to FIGS. 17A and 17B, a description is given of comparative ways of fixing side cores 164 and 264*a*.

FIG. 17A is a side view of the side core 164 pressed by a guide pin 173*a* in a mold 171, along a direction indicated by arrow X in FIG. 8 (hereinafter referred to as direction X). FIG. 17B is a side view of the side core 264*a* pressed by a guide pin 273*a* in a mold 271, along the direction X.

Figure 21:
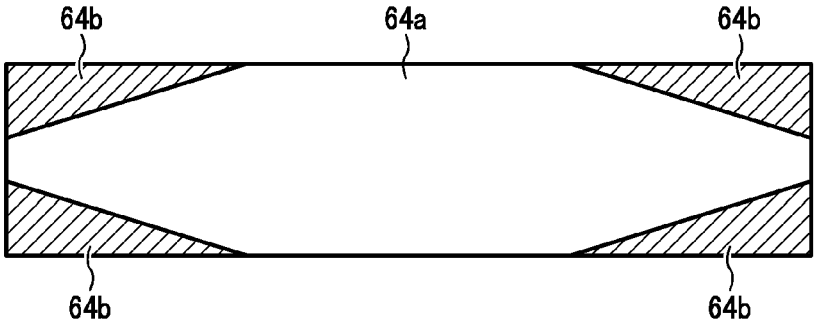
FIG. 21 RELATED ART
FIG. 21 is a side view of the typical side core of FIG. 20.

In FIG. 17A, the mold 171 has a stationary part 171*a* and a movable part 171*b*. The stationary part 171*a* includes the guide pin 173*a* while the movable part 171*b* includes guide pins 173 and a magnet 172 to stabilize the side core 164. The side core 164 is warped by a sintering process. When the warped side core 164 is stabilized in the mold 171, the center of the warped side core 164 is pressed by the guide pin 173*a* with a downward force F1. That is, the side core 164 is bent at three points, i.e., both ends and the center. Consequently, the side core 164 may be broken. In FIG. 17B, the mold 271 has a stationary part 271*a* and a movable part 271*b*. The stationary part 271*a* includes the guide pin 273*a* while the movable part 271*b* includes guide pins 273 and a magnet 272 to stabilize the side core 264*a*. The side core 264*a* has a center thicker than both ends, as in the side core 64*a* illustrated in FIG. 20. Such a configuration prevents the side core 264*a* from being broken due to the three point bending when the center of the side core 264*a* is pressed by the guide pin 273*a* with a downward force F2. However, such thinner ends eliminate a necessary volume of the side core 264*a*, such as a volume of notches 64*b* illustrated in FIG. 21. Accordingly, the heat generation efficiency is decreased.

According to the present embodiment, the side cores 64 are stabilized in the mold 71 with the spherical pins 74 each having a spherical tip and serving as a stabilizing member. The spherical pins 74 are biased by springs with an appropriate force and vertically stabilize the side cores 64. The spherical tips of the spherical pins 74 minimize damage to the side cores 64.

Figure 18A:
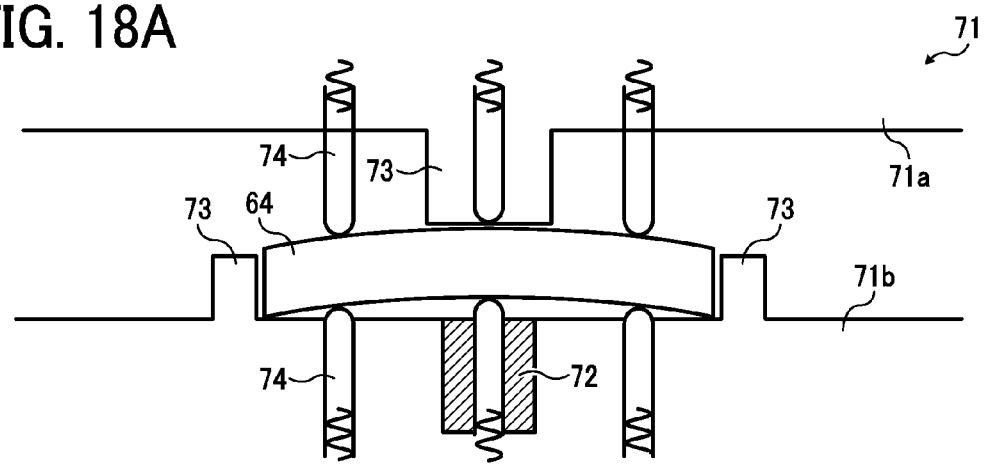
FIG. 18A is a side view of a side core as a first example.
Figure 18B:
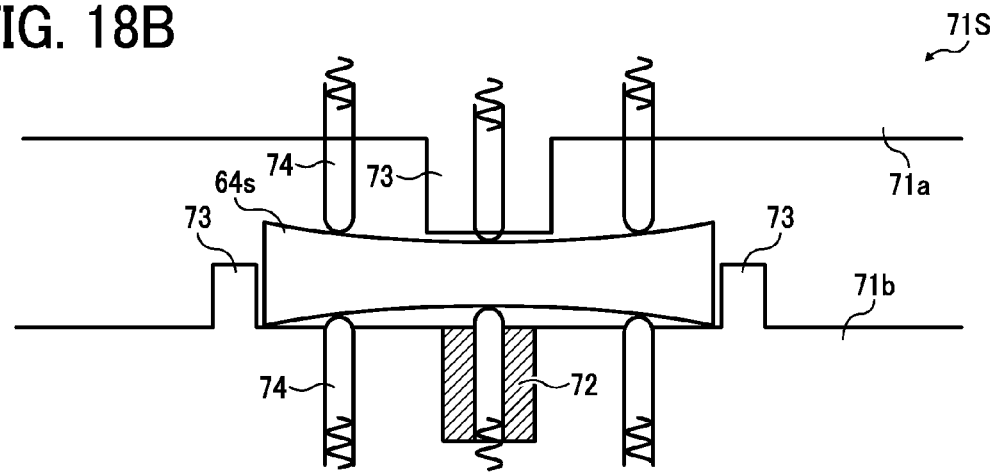
FIG. 18B is a side view of a side core as a second example.
Figure 18C:
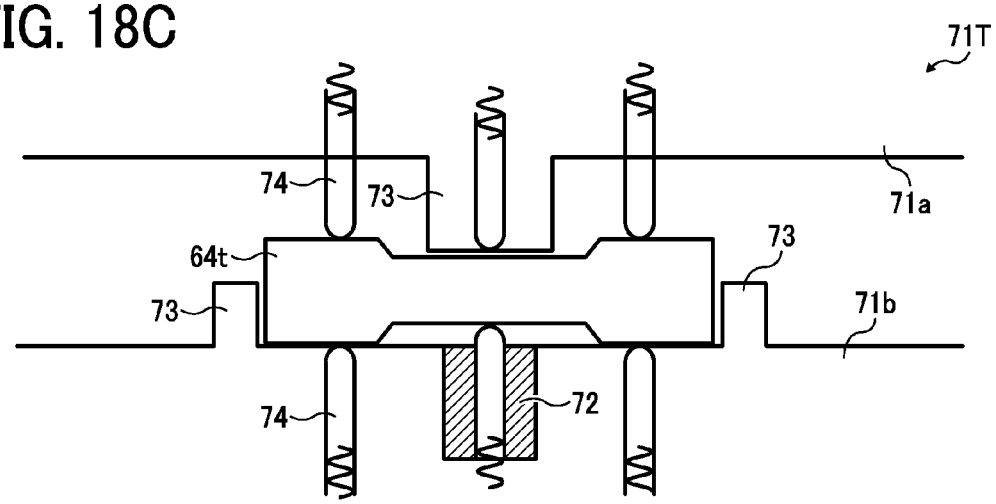
FIG. 18C is a side view of a side core as a third example.

Referring now to FIGS. 18A to 18C, a description is given of some examples of the side core 64 stabilized by the spherical pins 74 in the mold 71.

FIG. 18A is a side view of the side core 64 as a first example, along the direction X, stabilized in the mold 71. FIG. 18B is a side view of a side core 64*s* as a second example, along the direction X, stabilized in a mold 71S. FIG. 18C is a side view of a side core 64*t* as a third example, along the direction X, stabilized in a mold 71T.

In FIGS. 18A to 18C, the spherical pins 74 are arranged differently from those arranged in two rows in FIGS. 7 and 9. Specifically, in FIGS. 18A to 18C, the spherical pins 74 are arranged in three rows. If five spherical pins 74 are used, the spherical pin 74 of the stationary part 71*a* positioned at the center in FIGS. 18A to 18C may be disposed in the same line as the guide pin 73 illustrated in FIG. 9. The spherical pin 74 of the movable part 71*b* positioned at the center in FIGS. 18A to 18C may be disposed in the same line as the magnet 72 illustrated in FIG. 7. If three spherical pins 74 are used, the spherical pin 74 of the stationary part 71*a* positioned at the center in FIGS. 18A to 18C may be disposed in the same line as the guide pin 73 illustrated in FIG. 9. The spherical pin 74 of the movable part 71*b* positioned at the center in FIGS. 18A to 18C may be disposed in the same line as the magnet 72 illustrated in FIG. 7. The other two spherical pins 74 are disposed so that the three spherical pins 74 form a triangle.

According to the present embodiment, even if the side cores 64 are warped, the side cores 64 can be insert-molded in the case 65 without changing the shapes thereof. In addition, such warped side cores 64 can maintain a high heat generation efficiency.

As illustrated in FIG. 18A, the side core 64 is slightly warped but has a relatively flat shape including a flat surface. The side core 64 is insert-molded in the case 65 after the sintering process, without an additional process of, e.g., changing the shape thereof. Because the side core 64 having a relatively flat shape is insert-molded in the case 65, the arch core 62 can be disposed at any position on the side core 64. For example, the arch cores 62 may be disposed at ends more than at the center in the axial direction of the heating roller 41 to prevent decrease in the heat generation efficiency at the ends of the heating roller 41 in the axial direction thereof. In such a case, the arch core 62 preferably contacts not the center but an end of the side core 64 illustrated in FIG. 18A. As the side core 64 has a relatively flat shape, the arch core 62 can contact the end of the side core 64. Accordingly, the heat generation efficiency is enhanced at the ends of the heating roller 41 in the axial direction thereof, thereby preventing uneven temperature distribution of the heating roller 41.

In FIGS. 18B and 18C, each of the side cores 64*s* and 64*t* has a center as thick as that of the side core 64 as the first example. By contrast, each of the side cores 64*s* and 64*t* has ends thicker than those of the side core 64 as the first example. Cores having such shapes as illustrated in FIGS. 18B and 18C may be formed accidentally or purposely. The side cores 64*s* and 64*t* are stabilized by the spherical pins 74 that are vertically movable and therefore softly contact the side cores 64*s* and 64*t*. Accordingly, the side cores 64*s* and 64*t* are rarely broken. In addition, such thick ends increase the volume of the side cores 64*s* and 64*t* facing the heating roller 41. Accordingly, magnetic coupling to the excitation coil 61 is enhanced, thereby further increasing the efficiency of heating the heating roller 41.

In the present embodiment, odd-shaped cores such as the side cores 64*s* and 64*t* can be reliably stabilized without changing the shapes thereof. Accordingly, the cores can be insert-molded in the case 65 without being broken. In such a case, after the shaping process, the case 65 has three or more spherical pin marks 75 on its outer and inner surfaces, respectively, for each of the side cores 64.

Referring now to FIG. 19, a description is given of another example of arrangement of the spherical pins 74.

FIG. 19 is a plan view of the side core 64 stabilized by spherical pins 74*a* and 74*b*.

To ensure that the spherical pins 74 stabilize the side core 64 in the mold 71, the spherical pins 74 are pressed against the side core 64 preferably at three or more points on each of at least the top and bottom sides of the side core 64. According to this example, the side core 64 is stabilized by three spherical pins, namely, two spherical pins 74*a* and one spherical pin 74*b*. To further enhance the stability of the side core 64, as illustrated in FIG. 19, a triangle formed by the spherical pins 74*a* and the spherical pin 74*b* is preferably a substantially isosceles triangle. Specifically, each of the spherical pins 74*a* is disposed at a corner of the side core 64. The spherical pin 74*b* is disposed at a center in a longitudinal direction of the side core 64, adjacent to a longitudinal side thereof. In such a case, after the shaping process, the case 65 has three or more spherical pin marks 75 on its outer and inner sides, respectively, for each of the side core 64.

According to the embodiments of this disclosure, an image forming apparatus including a fixing device described above (e.g., image forming apparatus 100 including the fixing device 40) obviates additional processing or secondary processing of a ferromagnetic core (e.g., side core 64) and easily adjust the temperature distribution, thereby reducing production costs. In addition, a fixing member (e.g., heating roller 41) and the ferromagnetic core are positioned close together, thereby enhancing the heat generation efficiency.

According to the embodiments of this disclosure, a holder (e.g., case 65) includes spherical marks (e.g., spherical pin marks 75) after a shaping process of a holder (e.g., case 65). The spherical pin marks are created by spherical pins (e.g., spherical pins 74). The spherical pins softly contact the ferromagnetic core at a point, thereby stabilizing the ferromagnetic core. Accordingly, even if the ferromagnetic core is warped, the ferromagnetic core can be reliably insert-molded in the holder that holds an excitation coil (e.g., excitation coil 61) without an additional process of, e.g., changing the shape thereof. In addition, the ferromagnetic core is not broken during the shaping process of the holder, thereby maintaining a high heat generation efficiency. By using the spherical pins, holes (e.g., holes H) at which the ferromagnetic core is exposed after the shaping process of the holder are minimized, obviating the need to cover the holes.

The present invention, although it has been described above with reference to specific exemplary embodiments, is not limited to the details of the embodiments described above, and various modifications and enhancements are possible without departing from the scope of the invention. It is therefore to be understood that the present invention may be practiced otherwise than as specifically described herein. For example, elements and/or features of different illustrative exemplary embodiments may be combined with each other and/or substituted for each other within the scope of this invention. The number of constituent elements and their locations, shapes, and so forth are not limited to any of the structure for performing the methodology illustrated in the drawings.

What is claimed is:

1. A fixing device comprising:

a fixing member including a heat-generating layer; and an induction heater configured to inductively heat the fixing member, the induction heater including:

an excitation coil facing an outer circumferential surface of the fixing member and configured to generate a magnetic flux;

a ferromagnetic core assembly containing an arch-core facing the outer circumferential surface of the fixing member with the excitation coil interposed therebetween;

a side core facing the fixing member and contacting the arch core, the side core being configured to form a magnetic path to direct the magnetic flux generated by the excitation coil to the fixing member, the side core having a non-planar surface; and a holder configured to hold the excitation coil and the ferromagnetic core assembly, wherein:

the side core is insert-molded in and at least partially covered by the holder, the holder includes a plurality of spherical marks created by a plurality of stabilizing members each having a spherical tip, the spherical tip of the plurality of stabilizing member is in contact with the non-planar surface of the side core, the holder has three or more spherical marks on each of at least two sides of the side core, and one of the three or more spherical marks is at a center of the holder in a longitudinal direction thereof and two of the three or more spherical marks are at both ends of the holder in the longitudinal direction thereof;

the holder having an uncovered portion at which the side core and the arch core contact each other;

wherein a diameter of an open portion of one of the spherical marks by the holder is greater than the diameter of the open portion of the one of the spherical marks by the side core; and wherein the plurality of spherical marks are between a plurality of arch cores.

2. The fixing device according to claim 1, wherein each of the plurality of spherical marks has a hole therein at which the ferromagnetic core is exposed.

3. The fixing device according to claim 1, wherein the ferromagnetic core has a flat shape and is insert-molded in the holder without being processed after sintering.

4. The fixing device according to claim 1, wherein the ferromagnetic core has ends along an axial direction of the fixing member, the ends having a greater thickness than an axial center thereof.

5. An image forming apparatus comprising the fixing device according to claim 1.

6. The fixing device according to claim 1, wherein the side core is warped.

7. The fixing device according to claim 1, wherein the ferromagnetic core has ends along an axial direction of the fixing member, the ends having a different thickness than an axial center thereof.

* * * * *